US006415844B1

(12) United States Patent
Smith

(10) Patent No.: US 6,415,844 B1
(45) Date of Patent: Jul. 9, 2002

(54) GARAGE DOORWAY SCREEN APPARATUS

(76) Inventor: Iraline L. Smith, 109 Gorham Dr., Huntsville, AL (US) 35811

( * ) Notice: Subject to any disclaimer, the term of this patent is extended or adjusted under 35 U.S.C. 154(b) by 0 days.

(21) Appl. No.: 09/785,131

(22) Filed: Feb. 16, 2001

(51) Int. Cl.[7] ..... E06B 9/00
(52) U.S. Cl. ..... 160/216; 160/225
(58) Field of Search ..... 160/216, 225, 160/226, 227, 40, 28, 99, 100; 49/465, 55; 292/56, 68, 116, 218, 267

(56) References Cited

U.S. PATENT DOCUMENTS

| | | | | |
|---|---|---|---|---|
| 995,408 | A | * | 6/1911 | Lockwood |
| 1,779,000 | A | * | 10/1930 | Jones |
| 1,813,652 | A | * | 7/1931 | Abrams et al. |
| 1,849,024 | A | * | 3/1932 | McKee |
| 3,489,201 | A | * | 1/1970 | Curry, III et al. |
| 3,957,251 | A | * | 5/1976 | McCracken |
| 4,231,412 | A | | 11/1980 | Nowak |
| 4,378,043 | A | | 3/1983 | Sorenson |
| 4,673,019 | A | | 6/1987 | Silverthorne et al. |
| 5,437,134 | A | * | 8/1995 | Donnelly |
| D374,487 | S | | 10/1996 | Lacherza |
| 5,611,382 | A | | 3/1997 | Sferra |
| 5,904,199 | A | | 5/1999 | Messner |
| 5,988,256 | A | | 11/1999 | Winters |

* cited by examiner

*Primary Examiner*—Blair M. Johnson

(57) ABSTRACT

A garage doorway screen apparatus for allowing fresh air into a garage without allowing pests such as insects and mice into the garage. The garage doorway screen apparatus includes a screen assembly including at least one screen support member and also including at least one screen member being attached to the at least one screen support member with the screen assembly being adapted to be securely and removably disposed in a garage doorway.

5 Claims, 4 Drawing Sheets

GARAGE DOORWAY SCREEN APPARATUS

BACKGROUND OF THE INVENTION

1. Field of the Invention

The present invention relates to a garage doorway guard and more particularly pertains to a new garage doorway screen apparatus for allowing fresh air into a garage without allowing pests such as insects and mice into the garage.

2. Description of the Prior Art

The use of a garage doorway guard is known in the prior art. More specifically, a garage doorway guard heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,904,199; 4,378,043; 5,611,382; 4,231,412; 598,256; 4,673,019; and U.S. Pat. No. Des. 374,487.

While these devices fulfill their respective, particular objectives and requirements, the aforementioned patents do not disclose a new garage doorway screen apparatus. The inventive device includes a screen assembly including at least one screen support member and also including at least one screen member being attached to the at least one screen support member with the screen assembly being adapted to be securely and removably disposed in a garage doorway.

In these respects, the garage doorway screen apparatus according to the present invention substantially departs from the conventional concepts and designs of the prior art, and in so doing provides an apparatus primarily developed for the purpose of allowing fresh air into a garage without allowing pests such as insects and mice into the garage.

SUMMARY OF THE INVENTION

In view of the foregoing disadvantages inherent in the known types of garage doorway guard now present in the prior art, the present invention provides a new garage doorway screen apparatus construction wherein the same can be utilized for allowing fresh air into a garage without allowing pests such as insects and mice into the garage.

The general purpose of the present invention, which will be described subsequently in greater detail, is to provide a new garage doorway screen apparatus which has many of the advantages of the garage doorway guard mentioned heretofore and many novel features that result in a new garage doorway screen apparatus which is not anticipated, rendered obvious, suggested, or even implied by any of the prior art garage doorway guard, either alone or in any combination thereof.

To attain this, the present invention generally comprises a screen assembly including at least one screen support member and also including at least one screen member being attached to the at least one screen support member with the screen assembly being adapted to be securely and removably disposed in a garage doorway.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garage doorway screen apparatus which has many of the advantages of the garage doorway guard mentioned heretofore and many novel features that result in a new garage doorway screen apparatus which is not anticipated, rendered obvious, suggested, or even implied by any of the prior art garage doorway guard, either alone or in any combination thereof.

It is another object of the present invention to provide a new garage doorway screen apparatus which may be easily and efficiently manufactured and marketed.

It is a further object of the present invention to provide a new garage doorway screen apparatus which is of a durable and reliable construction.

An even further object of the present invention is to provide a new garage doorway screen apparatus which is susceptible of a low cost of manufacture with regard to both materials and labor, and which accordingly is then susceptible of low prices of sale to the consuming public, thereby making such garage doorway screen apparatus economically available to the buying public.

Still yet another object of the present invention is to provide a new garage doorway screen apparatus which provides in the apparatuses and methods of the prior art some of the advantages thereof, while simultaneously overcoming some of the disadvantages normally associated therewith.

Still another object of the present invention is to provide a new garage doorway screen apparatus for allowing fresh air into a garage without allowing pests such as insects and mice into the garage.

Yet another object of the present invention is to provide a new garage doorway screen apparatus which includes a screen assembly including at least one screen support member and also including at least one screen member being attached to the at least one screen support member with the screen assembly being adapted to be securely and removably disposed in a garage doorway.

Still yet another object of the present invention is to provide a new garage doorway screen apparatus that is easy and convenient to set up in one's garage doorway.

Even still another object of the present invention is to provide a new garage doorway screen apparatus that allows offensive odors and dangerous fumes to escape the garage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
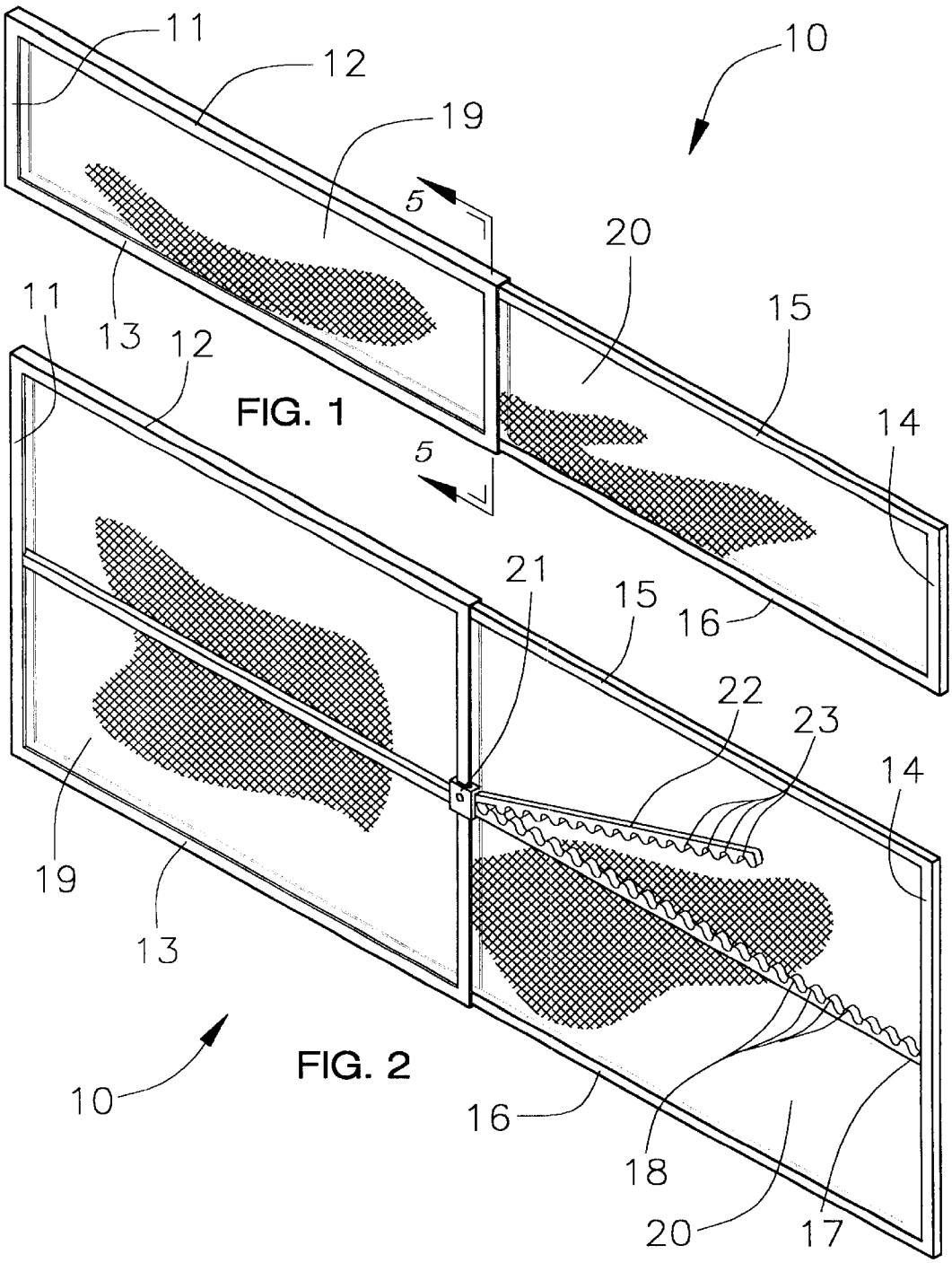
FIG. 1 is a perspective view of a first embodiment of a new garage doorway screen apparatus according to the present invention.
FIG. 2 is a perspective view of a second embodiment of the present invention.
Figure 3:
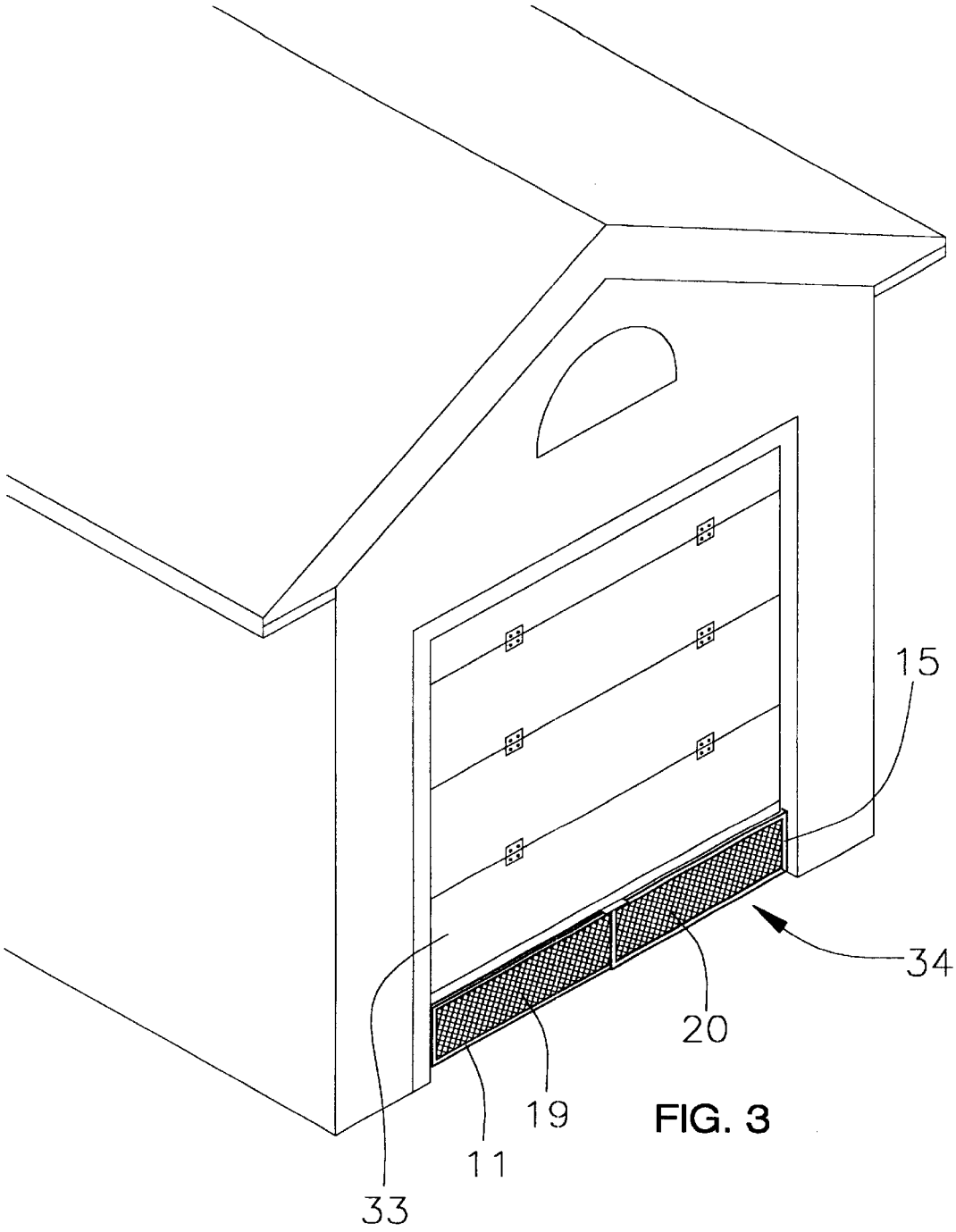
FIG. 3 is a perspective view of the first embodiment of the present invention shown in use.
Figure 4:
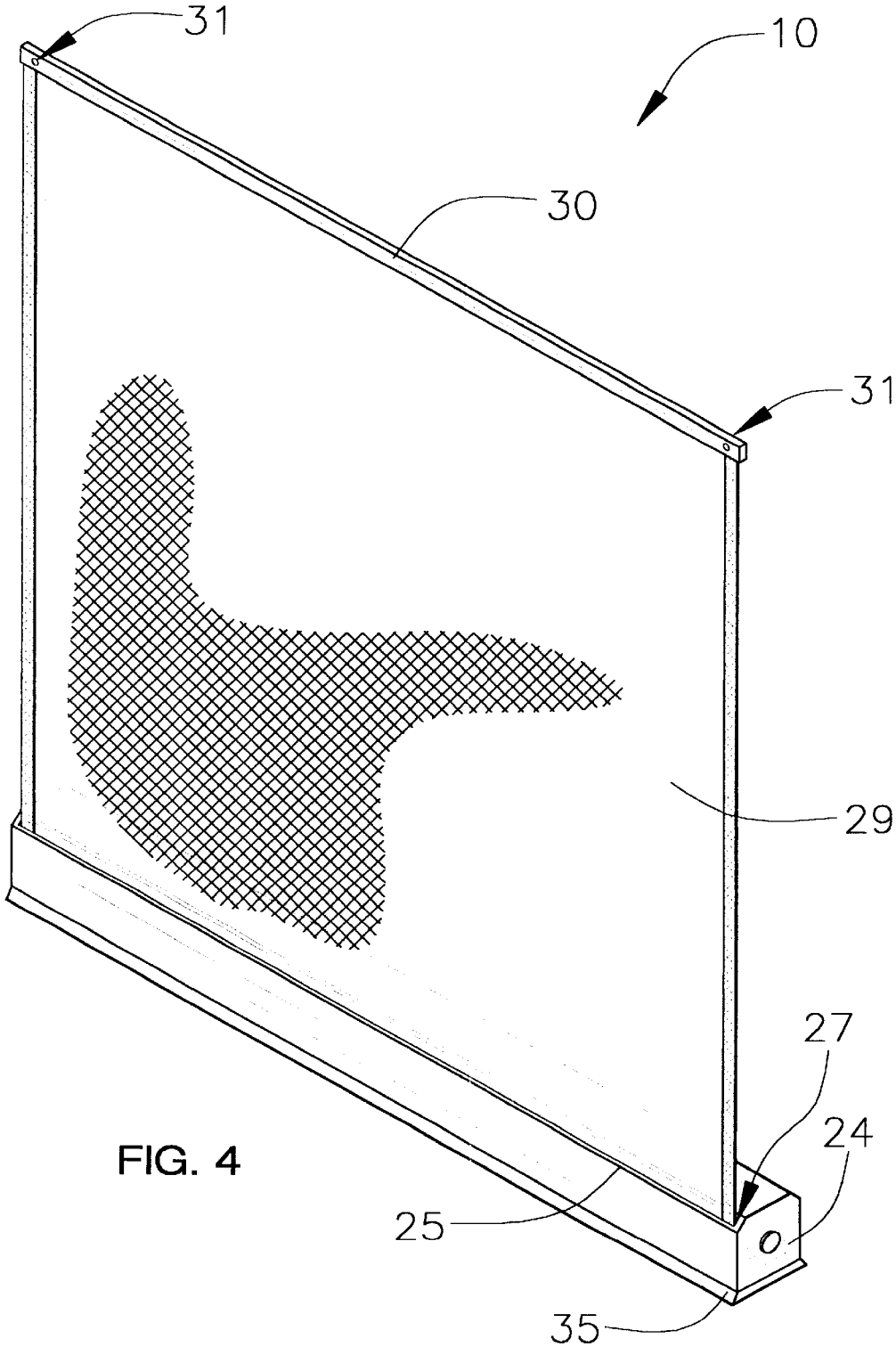
FIG. 4 is a perspective view of a third embodiment of the present invention.
Figure 5:
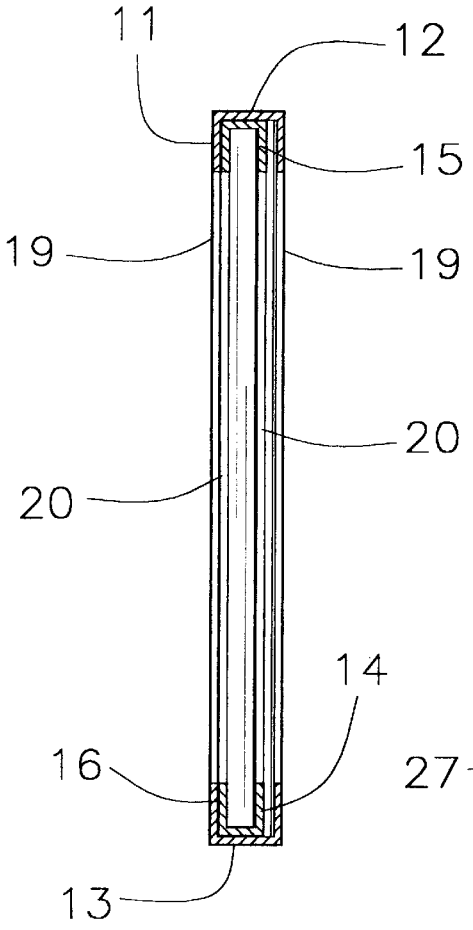
FIG. 5 is a cross-sectional view of the first embodiment of the present invention.
Figure 6:
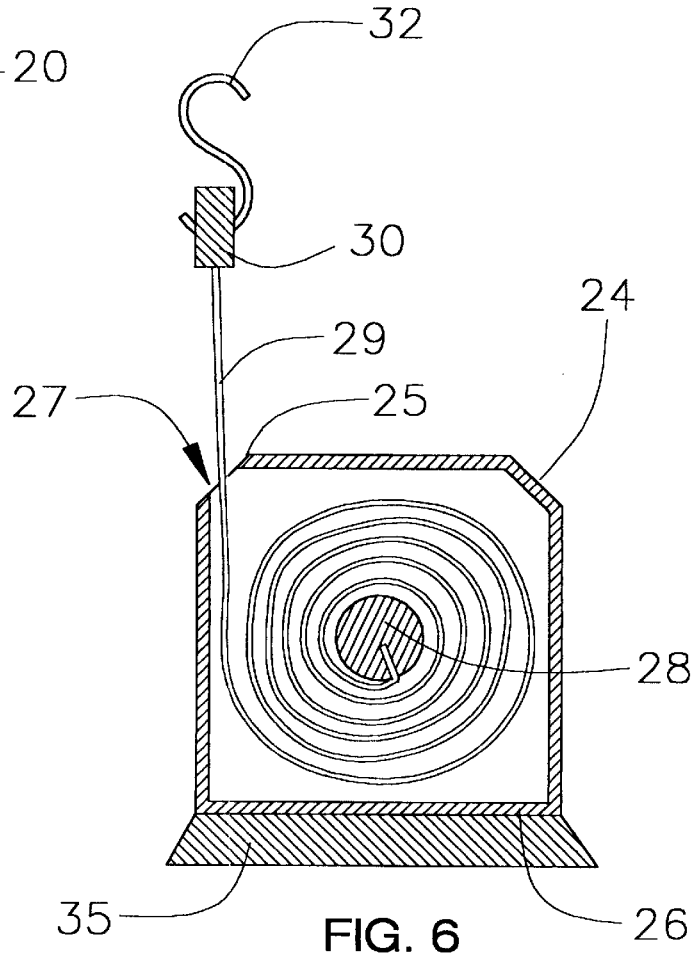
FIG. 6 is a cross-sectional view of the third embodiment of the present invention.

With reference now to the drawings, and in particular to FIGS. 1 through 6 thereof, a new garage doorway screen apparatus embodying the principles and concepts of the present invention and generally designated by the reference numeral 10 will be described.

As best illustrated in FIGS. 1 through 6, the garage doorway screen apparatus 10 generally comprises a screen assembly including at least one screen support member 11,14,30 and also including at least one screen member 19,20,29 being conventionally attached to the at least one screen support member 11,14,30. The screen assembly is adapted to be securely and removably disposed in a garage doorway 34. As a first and second embodiments, the at least one screen support member 11,14,30 includes a first frame member 11 and a second frame member 14 being telescopingly attached to the first frame member 11. The at least one screen member 19,20,29 includes first screen members 19 being securely and conventionally attached to the first frame member 11 and also includes second screen members 20 being securely and conventionally attached to the second frame member 14. The first frame member 11 includes an inverted U-shaped upper elongate cross member 12 and also includes a U-shaped lower elongate cross member 13. The second frame member 14 includes an inverted U-shaped upper elongate cross member 15 and also includes a U-shaped lower elongate cross member 16. The upper elongate cross member 115 of the second frame member 14 is slidably received in and extended from the upper elongate cross member 12 of the first frame member 11. The lower elongate cross member 16 of the second frame member 14 is slidably received in and extended from the lower elongate cross member 13 of the first frame member 11. For the second embodiment, the second frame member 14 further includes an elongate intermediate cross member 17 having a plurality of teeth 18 being spaced along and disposed in a top edge thereof. The screen assembly further includes a latch support member 21 being securely and conventionally attached to the first frame member 11 intermediate of the upper and lower elongate cross members 12,13, and also includes an elongate latch member 22 being pivotally and conventionally attached to the latch support member 21 and having a plurality of teeth 23 being spaced along and disposed in a bottom edge thereof. The elongate latch member 22 is fastenable to the elongate intermediate cross member 17 to lock the second frame member 14 at a desired position relative to the first frame member 11 with the teeth 23 of the elongate latch member 22 being interlockably connected to the teeth 18 of the elongate intermediate cross member 17.

As a third embodiment, the screen assembly further includes an elongate housing member 24 having a longitudinal slot 27 being disposed through a top corner 25 thereof and extending a length of the elongate housing member 24, and also includes a spindle 28 being rotatably and conventionally disposed in the elongate housing member 24, and further includes a weighted base member 35 being securely and conventionally attached to a bottom wall 26 of the elongate housing member 24, and also includes sinusoidal-shaped hook members 32 being removably and conventionally connected to the at least one screen support member 30 and being adapted to hook to a garage door 33. The at least one screen member 29 includes a screen member 29 being carried by the spindle 28 and being extendable through the longitudinal slot 27 of the elongate housing member 24. The at least one screen support member 30 includes a support bar 30 being securely and conventionally attached to a top edge of the screen member 29 and having holes 31 disposed therethrough and being adapted to receive the sinusoidal-shaped hook members 32.

In use, the user raises the garage door and places the garage doorway screen apparatus 10 in the doorway 34 of the garage such that the doorway screen apparatus 10 closes the space between the garage door 33 and the floor of the garage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A garage doorway screen apparatus comprising:

a screen assembly for removably positioning in a garage doorway in a gap formed in the garage doorway by a partially opened garage door, said screen assembly including a pair of screen support members, said pair of screen support members including a first frame member and a second frame member, said second frame member being mounted on said first frame member in a manner permitting telescoping sliding of said second screen member with respect to said first screen member; and a releasable locking assembly for releasably locking said second frame member in a plurality of telescoped positions with respect to said first frame member to prevent sliding of said second frame member with respect to said first frame member, said releasable locking assembly including:

an elongate intermediate cross member mounted on said second frame member, said intermediate cross member having a plurality of teeth being spaced along and disposed in a top edge thereof, said plurality of teeth defining a plurality of grooves therebetween; and a latch support member being attached to said first frame member;

an elongate latch member having a plurality of teeth being spaced along and disposed in a bottom edge thereof, said plurality of teeth defining a plurality of grooves therebetween, said elongate latch member being pivotally mounted on said latch support member for pivoting downwardly into an engaged position and upward into a disengaged position such that gravity biases said latch member toward said engaged position, said engaged position being characterized by the plurality of teeth of said latch member engaging the plurality of grooves of said intermediate cross member for resisting sliding movement of said second frame member with respect to said first frame member from a selected position, said disengaged position being characterized by the plurality of teeth of said latch member being disengaged from the plurality of grooves of said intermediate cross member for permitting sliding movement of said second frame member with respect to said first frame member.

2. A garage doorway screen apparatus as described in claim 1, additionally including first screen members being attached to said first frame member and second screen members being attached to said second frame member.

3. A garage doorway screen apparatus as described in claim 1, wherein said first frame member includes an inverted U-shaped upper elongate cross member and also includes a U-shaped lower elongate cross member.

4. A garage doorway screen apparatus as described in claim 3, wherein said second frame member includes an inverted U-shaped upper elongate cross member and also includes a U-shaped lower elongate cross member, said upper elongate cross member of said second frame member being slidable received in and extended from said upper elongate cross member of said first frame member, said lower elongate cross member of said second frame member being slidable received in and extended from said lower elongate cross member of said first frame member.

5. A garage doorway screen apparatus comprising:

a screen assembly for removably positioning in a garage doorway in a gap formed in the garage doorway by a partially opened garage door, said screen assembly including a pair of screen support members, said pair of screen support members including a first frame member and a second frame member, said second frame member being mounted on said first frame member in a manner permitting telescoping sliding of said second screen member with respect to said first screen member; and a releasable locking assembly for releasably locking said second frame member in a plurality of telescoped positions with respect to said first frame member to prevent sliding of said second frame member with respect to said first frame member, said releasable locking assembly including:

an elongate intermediate cross member mounted on said second frame member, said intermediate cross member having a plurality of teeth being spaced along and disposed in a top edge thereof, said plurality of teeth defining a plurality of grooves therebetween; and a latch support member being attached to said first frame member;

an elongate latch member having a plurality of teeth being spaced along and disposed in a bottom edge thereof, said plurality of teeth defining a plurality of grooves therebetween, said elongate latch member being pivotally mounted on said latch support member for pivoting downwardly into an engaged position and upward into a disengaged position such that gravity biases said latch member toward said engaged position, said engaged position being characterized by the plurality of teeth of said latch member engaging the plurality of grooves of said intermediate cross member for resisting sliding movement of said second frame member with respect to said first frame member from a selected position, said disengaged position being characterized by the plurality of teeth of said latch member being disengaged from the plurality of grooves of said intermediate cross member for permitting sliding movement of said second frame member with respect to said first frame member;

first screen members being attached to said first frame member and second screen members being attached to said second frame member;

wherein said first frame member includes an inverted U-shaped upper elongate cross member and also includes a U-shaped lower elongate cross member; and wherein said second frame member includes an inverted U-shaped upper elongate cross member and also includes a U-shaped lower elongate cross member, said upper elongate cross member of said second frame member being slidably received in and extended from said upper elongate cross member of said first frame member, said lower elongate cross member of said second frame member being slidably received in and extended from said lower elongate cross member of said first frame member.

* * * * *